United States Patent [19]

Hamada et al.

[11] Patent Number: 4,979,000

[45] Date of Patent: Dec. 18, 1990

[54] PAPER SEPARATING CHARGER CAPABLE OF DISCHARGING CURRENTS OF VARIOUS DUTY FACTORS AND FREQUENCIES

[75] Inventors: Jun-ichi Hamada; Masahiko Itaya; Mitsuo Motohashi, all of Hachioj, Japan

[73] Assignee: Konica Corporation, Tokyo, Japan

[21] Appl. No.: 402,459

[22] Filed: Sep. 1, 1989

[30] Foreign Application Priority Data

Sep. 20, 1988 [JP] Japan ..... 63-236721

[51] Int. Cl.[5] ..... G03G 21/00

[52] U.S. Cl. ..... 355/315; 361/235

[58] Field of Search ..... 355/315, 276, 274, 271; 271/310, 900; 361/229, 235, 214

[56] References Cited

U.S. PATENT DOCUMENTS 3,970,381 7/1976 Meagher et al. ..... 355/315

FOREIGN PATENT DOCUMENTS 53-17495 6/1978 Japan .
53-89430 8/1978 Japan .
54-106233 8/1979 Japan .

*Primary Examiner*—A. T. Grimley
*Assistant Examiner*—Nestor R. Ramirez
*Attorney, Agent, or Firm*—Frishauf, Holtz, Goodman & Woodward

[57] ABSTRACT

An electrophotographic image forming apparatus for forming an image on a recording sheet comprises a photosensitive drum for holding a toner image thereon, in developer for forming the toner image on the photosensitive drum, an image transfer device for electrostatically transferring the toner image from the photosensitive drum to the recording sheet, and a sheet separator for separating the recording sheet from the photosensitive drum as the recording sheet advances. The sheet is controlled to generate a discharge voltage which includes separator at least alternating currents at various duty factors.

8 Claims, 5 Drawing Sheets

PAPER SEPARATING CHARGER CAPABLE OF DISCHARGING CURRENTS OF VARIOUS DUTY FACTORS AND FREQUENCIES

BACKGROUND OF THE INVENTION

The present invention relates to an image forming apparatus such as an electrophotographic copying machine or the like, and more particularly to an image forming apparatus employing a novel separating method, wherein a recording sheet (usually a copy paper) to which a toner image has been transferred from an image carrying member on which the toner image was first developed by developing process, is then separated from the image carrying member by a separator having an A.C. component.

In the conventional image forming apparatus of the aforesaid type, both the transfer unit and the separating unit employ a corotron corona discharging device wherein a transfer electrode and a separation electrode in each, both comprised of a wire, or wires stretched over a photoreceptor as an image carrying member with a slight distance from the photoreceptor, conduct corona discharge. The function of the separating unit is to discharge by means of an A.C. corona discharging, the charge on a transfer material having thereon a toner image transferred thereto by means of a transfer unit and being attracted electrostatically to the surface of the image carrying member, and thereby to cause the recording sheet to be separated from the drum-shaped image carrying member. A separating function required for the separating unit is not only to cause the recording sheet to be separated from the image carrying member but also to cause the recording sheet to be separated with a perfect toner image thereon. Namely, even a part of a toner image on the recording sheet should not be transferred again to the image carrying member.

It is not easy to cause the transfer to satisfy such an exact separating function.

Japanese Patent Examined Publication No. 17495/1978 and Japanese Patent Publication Open to Public Inspection Nos. 89430/1978 and 106233/1979 have been suggested from the aforesaid viewpoint, and both of them are related to an idea wherein the aforesaid separating function is achieved by changing the conditions for separation between the leading edge and the remaining portion of a copy paper.

As a method of changing the value of the separation current on the half way of separating a copy paper from an image carrying member, the following have been suggested.

(a) To change the intensity of A.C. corona discharge.

(b) To change the value of a D.C. bias superposed on A.C.

(c) To use D.C. for neutralizing the charge at the leading edge of a copy paper and use A.C. for neutralizing the other portion thereof.

However, these ideas have the following disadvantages.

(a) Two or more power supply outputs are necessary, which is expensive.

(b) It is difficult to change the conditions for separation stepwise or continuously.

In the meantime, there has been proposed a method wherein only one power supply is used and only the charge at the leading edge of a copy paper is neutralized by cutting the power supply in the middle of separation of the copy paper. In this method, however, the separation efficiency in the transfer is deteriorated.

An object of the invention is to provide an image forming apparatus having a separating function which prevents toners once transferred onto a recording sheet from being re-transferred back to the photoreceptor, while satisfying the separation requirements for a recording sheet including its leading edge, by maneuvering the separation current.

In this case, the object is to provide an image forming apparatus, preferably having only one power supply for neutralization for separation for a cost saving, and having satisfactory separation caused by changing the conditions for separation stepwise or continuously controlled by a CPU that is provided on the main body of the image forming apparatus.

SUMMARY OF THE INVENTION

The aforesaid object may be achieved by an image forming apparatus comprising an image carrying member on which toner images are developed and then are transferred onto a recording sheet, and the recording sheet is separated from the image carrying member by means of a discharge signal containing at least an A.C. component. The voltage signal for separating the sheet from the image carrying member is applied on a separation electrode which is so provided as to face the image carrying unit. The duty factor or frequency of the discharge signal is changed as the recording sheet advances. The image forming apparatus comprises an image carrying member on which toner images are developed and which then are transferred onto a recording sheet. Then the recording sheet is separated from the image carrying member by means of the discharge signal containing at least an A.C. component being applied on a separation electrode which is so provided as to face the image carrying member. The frequency and/or the duty factor of the discharge signal is changed as the recording sheet advances.

The duty factor in this case is so defined as to mean the time ratio of ON to the total of a pair of ON and OFF for the discharge voltage.

DETAILED DESCRIPTION OF THE INVENTION

Figure 1:
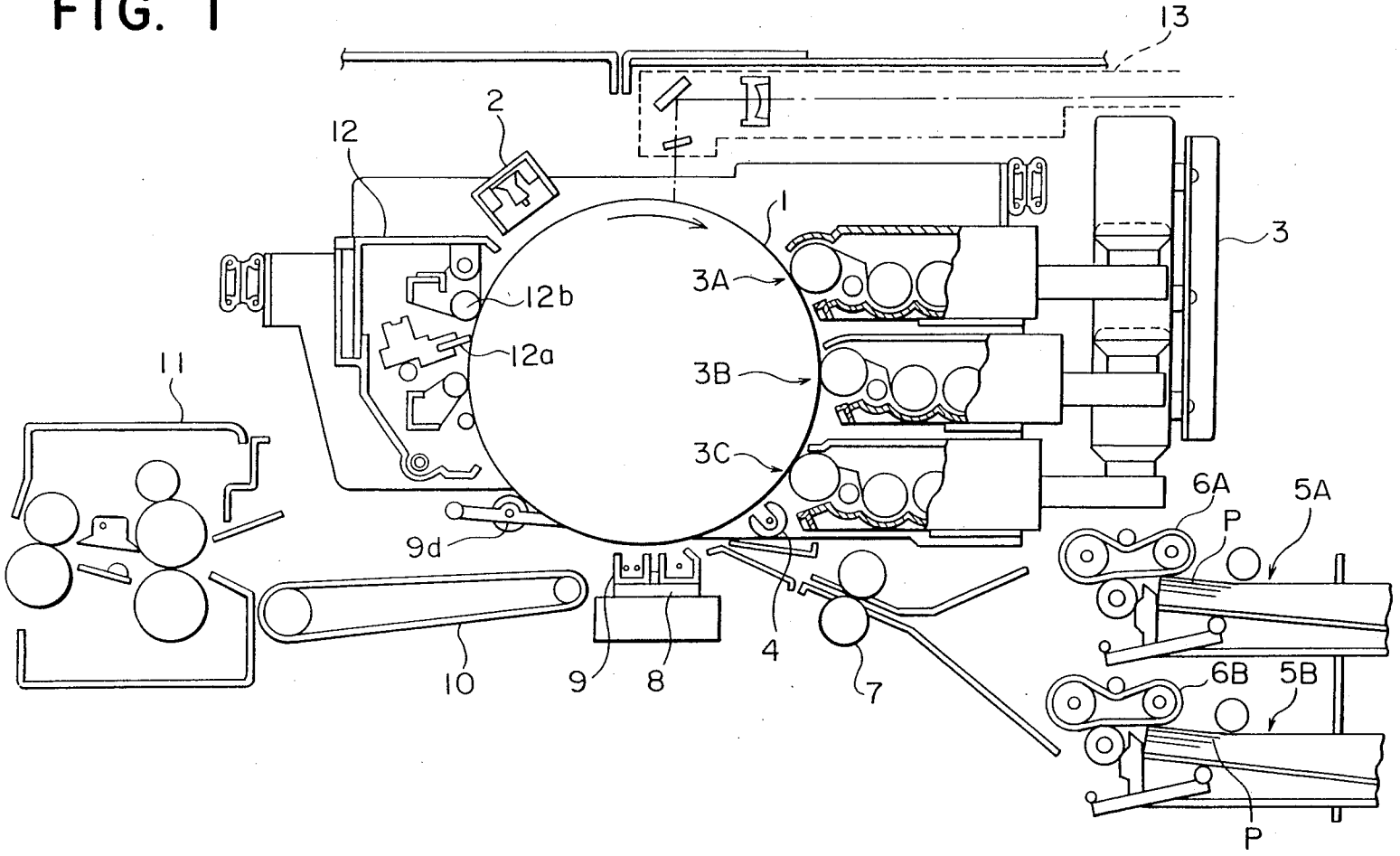
FIG. 1 is a sectional view of a main part of an image forming apparatus of an example of the invention.

Examples of the invention will be explained as follows. referring to the drawings.

In FIG. 1, 1 is a photoreceptor in a drum shape that is an image carrying member which rotates in the arrowed direction, 2 is a charging unit which uniformly charges photoreceptor 1, 13 is a unit for imagewise exposure provided with a writing means such as, for example, a laser beam, 3 is a developing module comprising, for example, a plurality of developing units 3A, 3B and 3C containing therein red color toner, blue color toner and black color toner respectively for multi-color recording, and 4 is a pretransfer exposure unit which illuminates photoreceptor 1 for neutralization thereof, all of them arranged around photoreceptor drum 1.

The apparatus further comprises a paper cassette 5A for ordinary copy paper and a paper cassette 5B for thicker copy paper. Each of 6A and 6B is a paper separating/feeding means which separates and feeds copy paper P sheet by sheet from each of the aforesaid paper cassettes 5A and 5B, and 7 is a second paper feed roller which transports copy paper P fed out toward the drum side of photoreceptor 1, and which is synchronized with the movement of toner images on photoreceptor 1.

Numeral 8 is a transfer unit which transfers toner images on photoreceptor 1 onto copy paper P, 9 is a separating unit which separates copy paper P having thereon toner images transferred thereto from a drum of photoreceptor 1, and 9*d* is a separating claw. Numeral 10 is a transport means that transports separated copied paper P to fixing unit 11, 12 is a cleaning unit, 12*a* is a cleaning blade and 12*b* is a cleaning roller.

An operation of the aforesaid example of the invention shown in FIG. 1 will now be explained.

First, photoreceptor 1 of an OPC type in the aforesaid image forming apparatus starts rotating in the arrowed direction, the surface of photoreceptor 1 is charged uniformly to be a negative polarity by charging unit 2, and then the imagewise exposure is carried out by imagewise exposure unit 13 on photoreceptor 1, resulting in the formation of the first (red) electrostatic latent image. This latent image is subjected to reversal development by developing unit 3A with red toner, resulting in the formation of red toner images. During the period of the aforesaid process, developing units 3B and 3C, pre-transfer exposure unit 4, second paper feed roller 7, transfer unit 8 and separating unit 9 do not operate and cleaning blade 12*a* and cleaning roller 12*b* of cleaning unit 12 withdraw so that they may not damage toner images developed on photoreceptor 1. After this, photoreceptor 1 is subjected to charging and the second exposure (blue) in the same way as the previous step, resulting in the reversal development made by developing unit 3B which causes the formation of blue images superposed on the aforesaid red images. Further, charging, the third exposure (black) and the reversal development made by developing unit 3C are made, resulting in the formation of black images. Photoreceptor 1 having thereon toner images is subjected to exposure by pre-transfer exposure unit 4 which has a neutralizing effect to the residual charge on the photoreceptor 1. Copy paper P is fed out by first paper feed roller 6A or 6B from paper cassette 5A or 5B and then transported, being synchronized with the rotation of photoreceptor 1, to the transfer section by means of second paper feed roller 7, and the aforesaid 3-color toner images made on the photoreceptor 1 are transferred onto copy paper P by means of transfer unit 8 which is a D.C. corona charging unit. Copy paper P having thereon transferred toner images is separated from photoreceptor 1 by separating unit 9 which will be described later, and then transported to fixing unit 11 by means of transport means 10 and then ejected out of the apparatus after being fixed. Photoreceptor 1 from which copy paper P has been separated keeps rotating so as to be cleaned by cleaning unit 12, in preparation for the next image formation.

Figure 2:
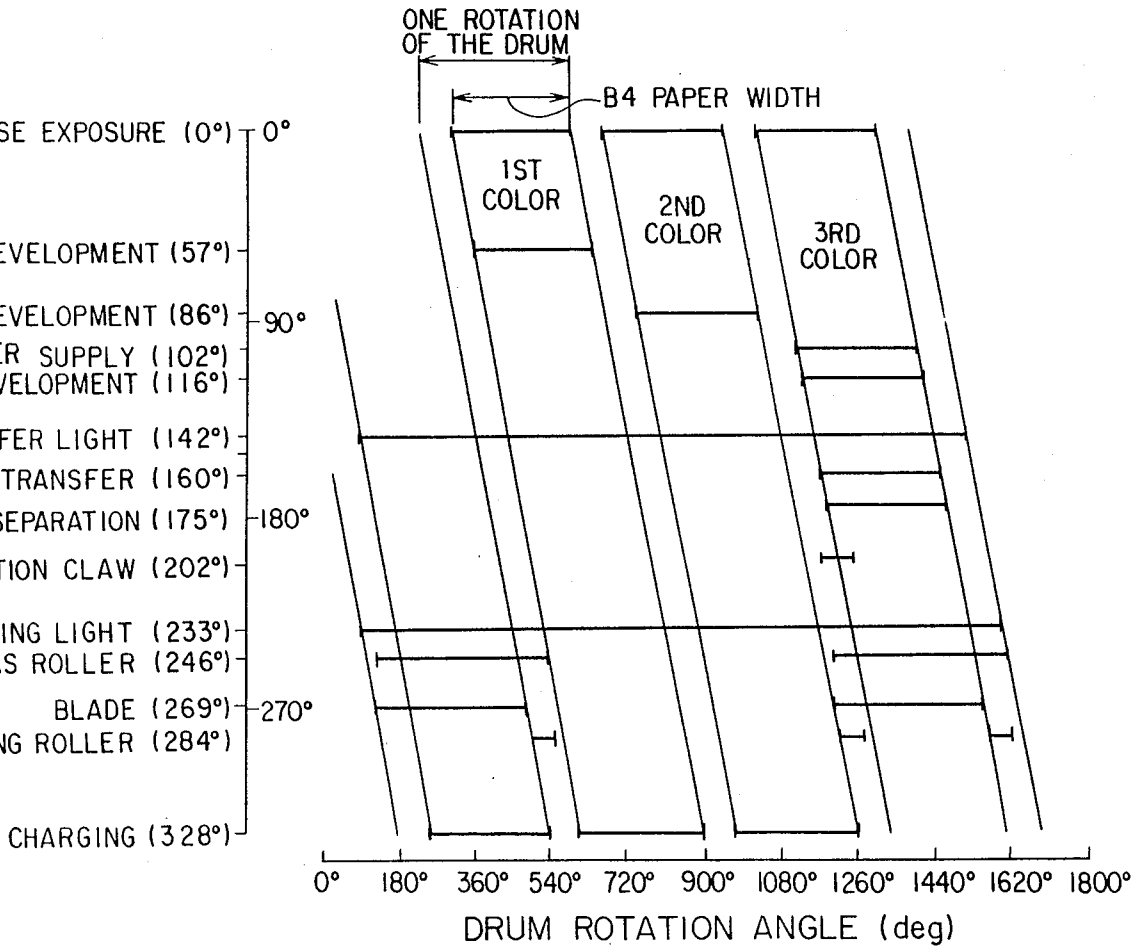
FIG. 2 is a timing chart for the image forming apparatus shown in FIG. 1.

FIG. 2 shows a timing chart for a copying operation under the condition of a 3-color mode of red, blue and black on the electrostatic recording apparatus shown in FIG. 1. In the figure, the abscissa axis represents drum rotation angles from the starting position of the photoreceptor drum, while, the ordinate axis represents operating members arranged, in the order according to the drum rotation, along the peripheral surface of the photoreceptor drum, and their positions are shown with angle values from the starting point which is an imagewise exposure section. Incidentally, in the case of a 2-color mode of red/black or blue/black, two developing units are to be switched on, skipping either the first color development or the second color development, and the timing chart in this case is one shortened by 360° in terms of rotation angle.

Figure 3:
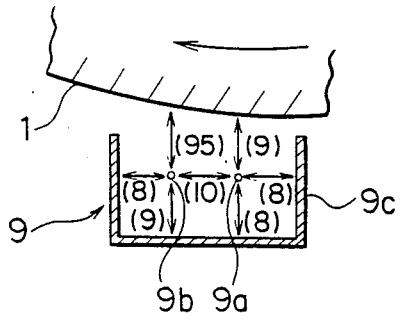
FIG. 3 is a sectional view of a separation unit shown in FIG. 1.

FIG. 3 is a sectional view of separating unit 9 of the image forming apparatus shown in FIG. 1. The separating unit 9 has therein separating electrodes 9*a* and 9*b* comprising of two wires which are stretched in parallel across photo-receptor 1 and covered with shielding member 9*c* at their rear sides. The detailed position of separating unit 9 opposing image carrying member 1 is shown in FIG. 3, wherein figures in parentheses represent dimensions in mm.

Figure 4:
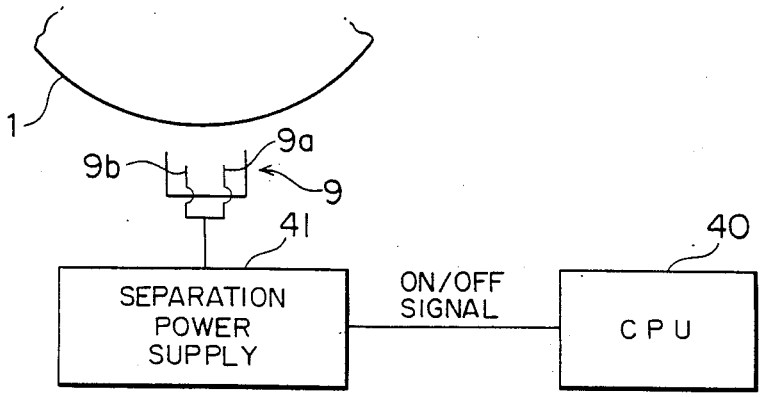
FIG. 4 is a block diagram showing a control system used in the invention.

FIG. 4 is a block diagram for control of separating unit 9, wherein separation power supply 41 for separating unit 9 is controlled by CPU 40. Separation control for separating unit 9 in the present example is carried out as follows.

Image carrying member 1 rotates clockwise at a circumferential speed of 70 mm/sec and images thereon are transferred onto a copy paper, synchronously transported with that speed, and kept in contact with image carrying member 1. When the leading edge of the copy paper reaches near an opening of separating unit 9, CPU 40 generates ON signals to cause separation power supply 41 to apply A.C. high voltage on separating electrodes 9*a* and 9*b*.

The voltage to be applied continuously in this case includes an A.C. bias voltage of 500 Hz from a constant voltage power supply as well as a D.C. power supply of $-7.5\ \mu A$ from a constant current power supply superposed on the former.

Then, when the leading edge of the copy paper advances past separating electrodes 9*a* and 9*b* by 100 mm, namely, after the leading edge has advanced at a speed of 70 mm/sec for 1.4 sec after the generation of on signal, CPU 40 controls separation power supply 41 to conduct separation discharge intermittently on an ON/-OFF basis.

Figure 5:
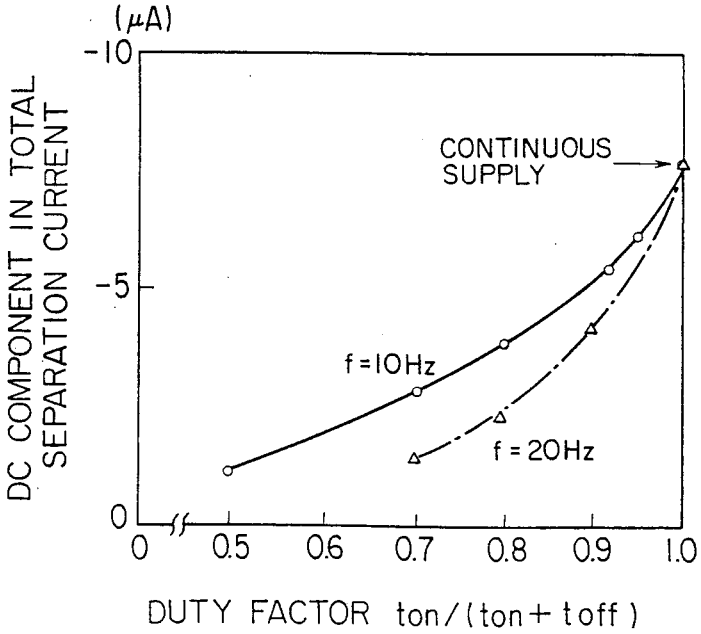
FIG. 5 is a graph showing the relation between the duty factor and the separation current for each ON/-OFF frequency, and FIGS. 6(*a*) to 6(*d*) show respective typical examples of separation waveforms of the invention.
Figure 6A:
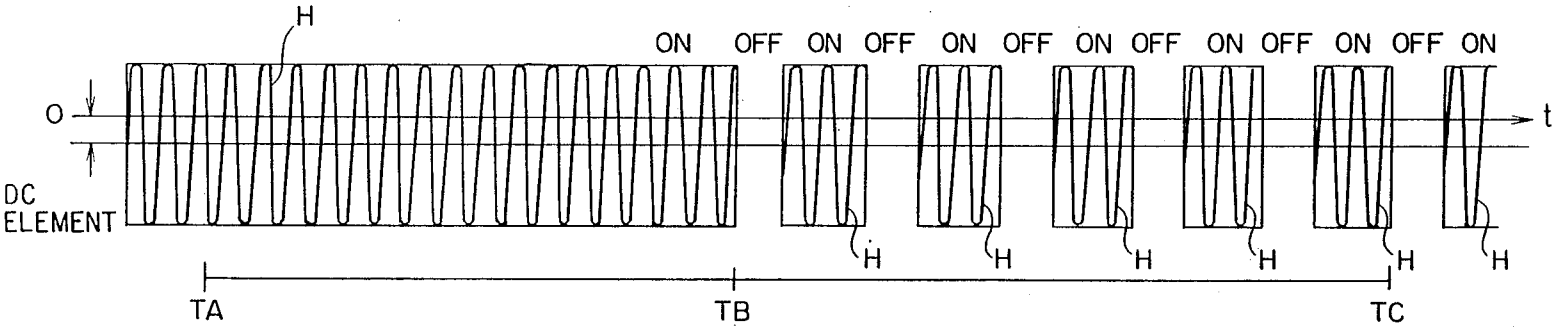
Figure 6B:
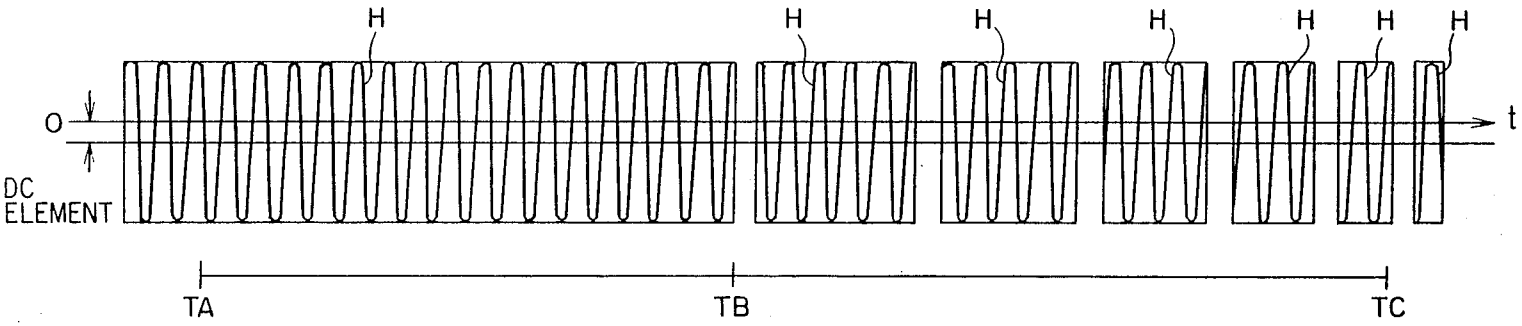
Figure 6C:
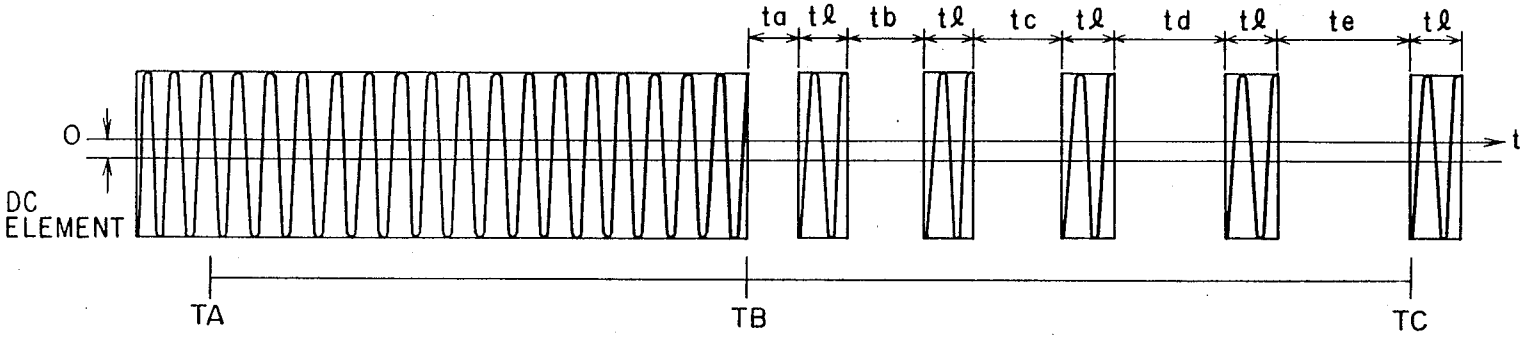
Figure 6D:
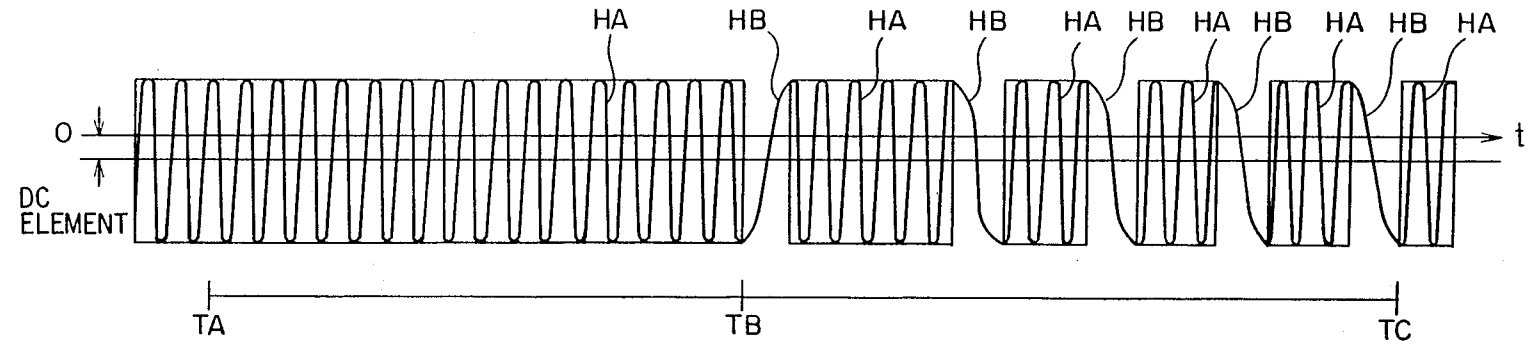

In the conditions of intermittent ON/OFF control in the present example, an ON/OFF frequency is set to be 10 Hz and a duty factor is set to be 0.8 (period of time for ON is 0.08 sec and that for OFF is 0.02 sec) and these conditions are kept until the trailing edge has passed separating electrodes 9*a* and 9*b*, and after its passage, CPU 40 sends OFF signals to separation power supply 41. Intermittent applying of voltage on an ON/-OFF basis under the aforesaid conditions lowers the D.C. component having $-7.5\ \mu A$ as a separation current for continuous discharge down to $-4\ \mu A$. This relation is represented in FIG. 5 wherein the relation between duty factors and D.C. components of separation current for ON/OFF frequencies of 10 Hz and 20 Hz are shown in the form of a graph.

Through the process mentioned above, the leading edge of a copy paper kept in contact with photoreceptor 1 is separated first, and then the copy paper itself is separated entirely. In the present example, the deterioration of separating property at the leading edge of a copy paper is prevented by the continuous separation discharge and the deterioration of image quality caused by re-transferring which have been taking place in the middle portion of an image and partial lack of an image in the trailing edge portion of an image respectively, is prevented by the intermittent discharge following the aforesaid continuous separation discharge. Especially in an image forming apparatus wherein multi-color toner images superposed on the photoreceptor surface are transferred together and separated as explained in the present example, the separation has frequently caused an image quality to be deteriorated. Owing to the present invention, a separation function which will not adversely affect image quality has been achieved.

In the example mentioned above, the frequency was set to 10 Hz for the intermittent separation discharge, but the frequency to be set does not need to be fixed to a constant value. With regard to 1 clock value (period of time for applying each ON/OFF), however, there is a restriction related to the process speed of an image carrying member, and according to experiments made by the inventors of present invention, the following conditions are necessary for separation which does not cause cyclic uneven density.

(process speed) mm/sec × (clock) sec < 10 mm

The foregoing is an explanation for one example of the invention wherein an ON/OFF frequency and a duty factor in the present example are set and controlled by the program of CPU 40. The program of CPU can also be changed as follows.

(a) In the example mentioned above, an ON/OFF control is made for the separation voltage wherein a D.C. component and an A.C. component are superposed together. This can be changed to the mode wherein an A.C. component only is controlled on an ON/OFF basis, while a D.C. component is constantly applied during the entire period of operation of an apparatus.

(b) The intermittent ON/OFF control in the example mentioned above can be changed to the mode wherein the duty factor is lowered gradually stepwise or continuously while the frequency is kept constant. In any case, in the example mentioned above, an ON/OFF control is made with the frequency of an A.C. discharge voltage kept constant. However, the A.C. frequency can be varied as a copy paper advances for achieving the separation function.

(c) The frequency for the A.C. discharge voltage is controlled so as to vary as a recording sheet advances.

(d) The control is made so that the low frequency component is mixed intermittently with the frequency of the discharge voltage after a transfer material has advanced for a predetermined period of time.

FIGS. 6 (*a*)–(*c*) represent the aforesaid examples and each of the figures shows a part of each example typically. In all of the figures, the abscissa axis represents time, TA represents the moment when the leading edge of a copy paper reaches a separating unit, TB represents the moment when the leading edge of a copy paper has passed the separating unit by 100 mm or for an appropriate distance calculated from the size of a recording paper, a diameter of a photoreceptor drum and others, and TC represents a moment when the trailing edge of a copy paper has passed the separating unit. In each of FIGS. 6 (*a*), (*b*) and (*c*), the frequency of the A.C. discharge voltage is H Hz and an ON/OFF control is repeated after the moment of TB. In FIG. 6 (*a*), the control is made so that both the ON/OFF cycle and the duty factor may be kept constant. In FIGS. 6 (*b*), the control is made so that the duty factor may be lowered while the ON/OFF cycle is accelerated gradually, and in FIG. 6 (*c*), the control is made so that the duty factor may be lowered under the condition that the ON time is kept constant and OFF time periods—ta, tb, tc, td and te—are set so that they may satisfy the time scale relation of 'ta<tb<tc<td<te'. In FIG. 6 (*d*), there is shown a control wherein high voltage power supplies of 500 Hz represented by HA and 10 Hz represented by HB are included in separation power supply 41 to be switched to either one of them, and a copy paper reaches the separating unit and after it has passed the point of TB, the low frequency component represented by TB is mixed intermittently under a switching control. Further, the duty factor in each example may be changed based on the thickness and size of the recording paper used.

As stated in the examples, the present invention has achieved a perfect separating function which is free from re-transferance of toner images owing to the control wherein the frequency of an A.C. discharge voltage is kept constant for the distance from the leading edge of a recording sheet to a predetermined point thereon which corresponds to a predetermined period of time for the recording sheet to advance, and then at least the corona discharge thereafter is controlled intermittently on an ON/OFF basis. The separation corona discharge in the invention is controlled according to the program of a CPU, namely by the ON/OFF control or the switching control generated from the CPU. Therefore, it is possible to set the conditions for separation easily and precisely, resulting in a sufficient separating function which may be carried out even in a multi-color image forming apparatus stated in the examples.

What is claimed is:

1. An electrophotographic image forming apparatus for forming an image on a transfer material, comprising;

image holding means for holding a toner image thereon, developing means for forming said toner image on said image holding means, image transfer means for electrostatically transferring said toner image from said image holding means to said transfer material, separation means for separating said transfer material, which is attached to said image holding means, from said image holding means, by means of a discharge signal, and generating means coupled to said separation means for generating a discharge signal including at least alternating currents at various duty factors and for applying said discharge signal to said separation as said transfer material advances relative to said separation means.

2. The apparatus of claim 1, wherein said generating means includes means for generating a direct current component included in said discharge signal.

3. The apparatus of claim 2, wherein said discharge signal generated by said generating means includes said direct current component and said alternating currents in the same timing.

4. The apparatus of claim 1, wherein said generating means includes means for generating at least said alternating currents at various duty factors discontinuously according to a predetermined graduation.

5. The apparatus of claim 1, wherein said generating means includes means for generating at least said alternating currents at various duty factors continuously according to a predetermined graduation.

6. The apparatus of claim 1, wherein said generating means includes means for generating at least said alternating currents at a same duty factor discontinuously in a predetermined timing.

7. An electrophotographic image forming apparatus for forming an image on a transfer material, comprising;

image holding means for holding a toner image thereon, developing means for forming said toner image on said image holding means, image transfer means for electrostatically transferring said toner image from said image holding means to said transfer material, separation means for separating said transfer material which is attached to said image holding means, from said image holding means, by means of a discharge signal, and generating means coupled to said separation means for generating a discharge signal including at least alternating currents of various frequencies and for applying said discharge signal to said separation according to an advanced position of said transfer material relative to said separation means.

8. The apparatus of claim 7, wherein said generating means includes means for generating said discharge signal so as to include a first alternating current component of a first frequency and a discontinuous second alternating current component of a second frequency after a predetermined period of time after generation of said first alternating current component.

* * * * *

UNITED STATES PATENT AND TRADEMARK OFFICE

CERTIFICATE OF CORRECTION

PATENT NO. : 4,979,000

DATED : December 18, 1990

INVENTOR(S) : HAMADA et al

It is certified that error appears in the above-identified patent and that said Letters Patent is hereby corrected as shown below:

Title page, Section [56] References Cited:

Insert under "U.S. PATENT DOCUMENTS" -

--4,286,862 9/1981 Akita et al....355/315--

Insert under "FOREIGN PATENT DOCUMENTS" -

--0150070 8/1985 Japan

Abstract, line 9:

after "sheet", insert --separator--.

Signed and Sealed this

Eighth Day of September, 1992

*Attest:*

DOUGLAS B. COMER

*Attesting Officer*

*Acting Commissioner of Patents and Trademarks*